US005284339A

United States Patent [19]

van Opstal et al.

[11] Patent Number: 5,284,339

[45] Date of Patent: Feb. 8, 1994

[54] SHEET DEPOSITION SYSTEM

[75] Inventors: Franciscus C. P. van Opstal, Velden; Peter J. A. Sampers, Linne, both of Netherlands

[73] Assignee: Oce-Nederland B.V., Venlo, Netherlands

[21] Appl. No.: 917,965

[22] Filed: Jul. 24, 1992

[30] Foreign Application Priority Data

Aug. 1, 1991 [NL] Netherlands ..... 9101324

[51] Int. Cl.[5] ..... B65H 39/10

[52] U.S. Cl. ..... 271/288; 271/293; 271/294; 271/298

[58] Field of Search ..... 271/279, 288, 292, 293, 271/294, 298

[56] References Cited

U.S. PATENT DOCUMENTS

| | | | |
|---|---|---|---|
| 4,466,609 | 8/1984 | Lawrence | 271/293 |
| 4,880,223 | 11/1989 | Yamazaki et al. | 271/293 |
| 5,042,793 | 8/1991 | Miyake | 271/294 X |
| 5,106,076 | 4/1992 | Fujita et al. | 271/288 X |

FOREIGN PATENT DOCUMENTS

| | | | |
|---|---|---|---|
| 0141353 | 9/1982 | Japan | 271/294 |
| 0223658 | 12/1984 | Japan | 271/293 |

OTHER PUBLICATIONS

Research Disclosure, (22802) *Device for Delivering Collated Copy-Sets*, Apr. 1983.

Foreign Search Report.

*Primary Examiner*—M. Grant Skaggs

*Assistant Examiner*—Carol L. Druzbick

*Attorney, Agent, or Firm*—Birch, Stewart, Kolasch & Birch

[57] ABSTRACT

A system for selective deposition of sheets on supports situated one above the other, each such support being movable into a deposition position in which a sheet deposition device disposed at a fixed place can deposit a sheet on the associated support or on a stack of sheets situated thereon. A support situated at a higher level is movable between its deposition position in which the support or the top edge of a stack of sheets disposed thereon is at the height of the sheet deposition means, and a parking position (A) in which at a higher level than the sheet deposition device. The next lower support is movable between its deposition position in which the support or the top edge of a stack of sheets disposed thereon is at the height of the sheet deposition device, and a parking position (B) in which the top edge of a stack of sheets to be formed thereon is at a lower level than the next higher support when the latter is in the deposition position with a stack of sheets thereon.

11 Claims, 6 Drawing Sheets

SHEET DEPOSITION SYSTEM

BACKGROUND OF THE INVENTION

The present invention relates to a sheet stacking system, and more specifically to a sheet deposition device for receiving deposited sheets from a sheet depositing configuration on supports situated one above the other within a framework of the device.

DISCUSSION OF RELATED ART

A sheet stacking device is known from the Research Disclosure Bulletin of April 1983, page 146, No. 22802. Therein is described a device in which the supports, at fixed distances one above the other, are disposed in a casing movable up and down to enable each support to be moved into a deposition position. A device of this kind is used in a copying machine marketed by Océ-van de Grinten N.V. under the name Océ-2500. In this known configuration, the supports form a number of deposition bins in each of which sets of copy sheets made in the copying machine can be deposited. When the casing does not contain any sheets, the empty casing is adjusted s that its bottom support level corresponds with a pair of delivery rollers acting as sheet deposition means and the casing projects with the other supports above the pair of delivery rollers over a distance corresponding substantially to the total height of the casing. The casing moves down during the time when the deposition bins are being filled with sets of copy sheets. When the consecutive bins have been successively filled with sheets of copy sheets, the casing has been moved down over a distance corresponding substantially to the total height of the casing. If there are following sets of copy sheets to be deposited, the casing is first emptied and then moved upwards until the bottom support is again level with the pair of delivery rollers. The deposition of sets of copy sheets can then be resumed.

A sheet deposition device of this known type is attractive because of the common short distance that sheets only have to cover to reach each of the bins, thus the risk of any malfunction during the transport of copy sheets is small. However, one disadvantage to this known sheet deposition device is that considerable space is required to move the bin casing up and down, i.e. almost twice the volume of the casing. Another disadvantage is in the fixed nature of the distances of the supports.

SUMMARY OF THE INVENTION

Therefore, it is an object of the present invention to provide a sheet stacking device which will overcome the above noted disadvantages.

A further object of the present invention is to provide a sheet stacking device for a copying machine wherein supports for deposited sheets are separately movable a predetermined distance to minimize the overall distance the supports have to be moved.

Still, a further object of the present invention is to provide a device for depositing sheets on supports situated one above the other and that the space required for moving the supports up and down is substantially reduced.

The foregoing objects, and others, are accomplished in accordance with the present invention generally speaking by providing a sheet stacking device including a first support movable into a position by a positioning means in which the distance to a next higher support is less than a predetermined maximum thickness of a stack of sheets to be formed on the first support. The positioning means selectively places the supports in a sheet deposition position at a level with a sheet deposition means for depositing sheets, such as in conjunction with a copying machine, on a support disposed or positioned in the sheet deposition position or on a stack of sheets previously disposed on the respective support. The effect of this is that the space required for moving the supports up and down is much smaller than twice the volume occupied by the deposited sheets. When the first support is movable to just beneath the next higher second support, this volume reduction comprises the volume of the maximum stack of sheets formable on the first support. Preferably, the maximum thickness of a stack of sheets formable on the first support is greater than the maximum of the stack of sheets formable on the second support. The effect of this is that direct changeover from depositing sheets on a higher support to depositing them on a lower support requires little time since, when the higher support moves upwards as is required for this changeover, over a distance corresponding to the thickness of the stack formed on the higher support, only this distance has to be traversed. Even if the number of supports is limited to two, deposition of sheets can be continued continuously without interruption when sheets deposited on one of the two supports are removed as deposition of sheets takes place on the other support.

BRIEF DESCRIPTION OF DRAWINGS

Other features and advantages of the invention will be explained with reference to the accompanying drawings wherein.

DETAILED DISCUSSION

Figure 1:
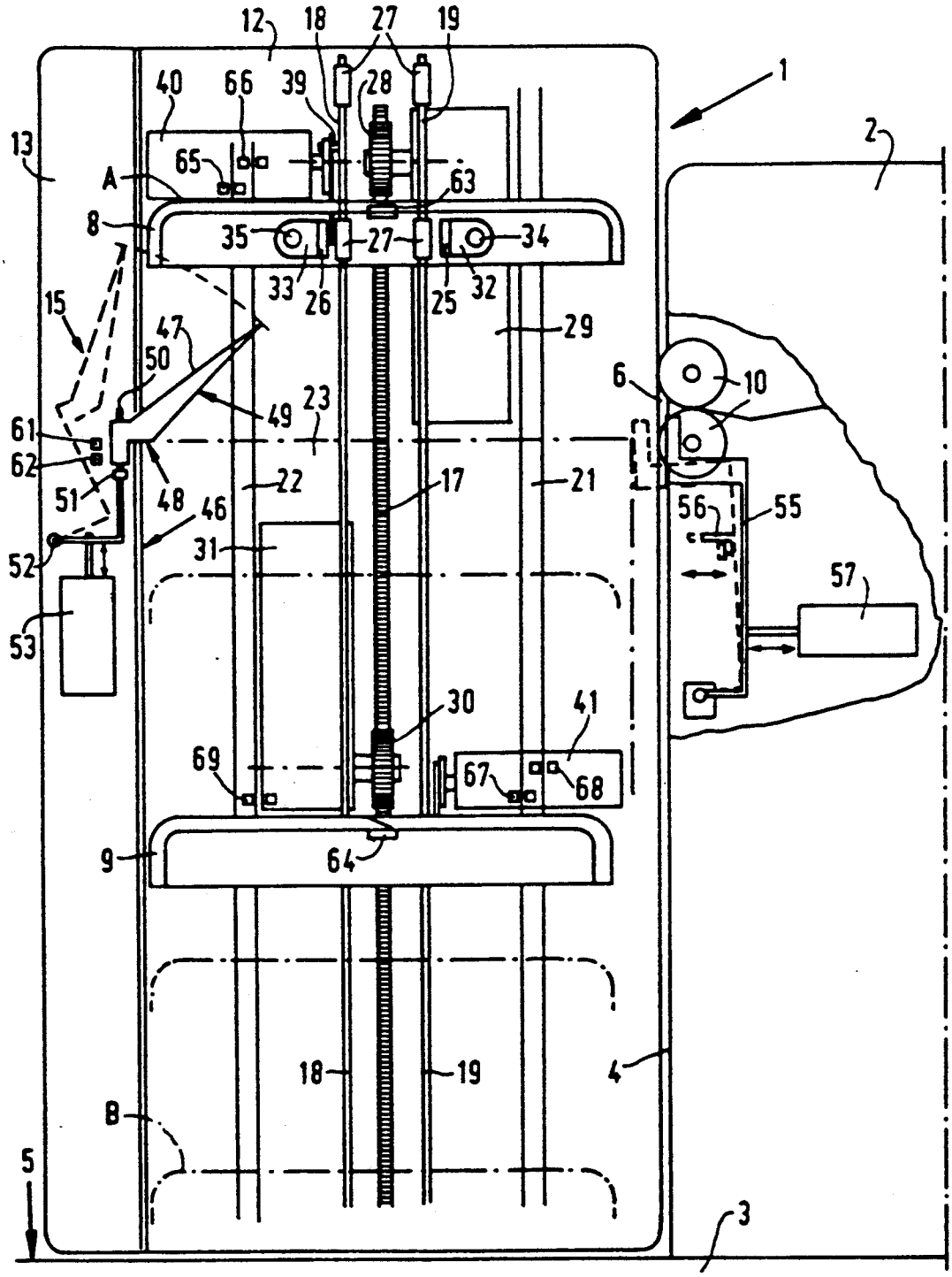
FIG. 1 is a front elevation of a device according to the invention.
Figure 2:
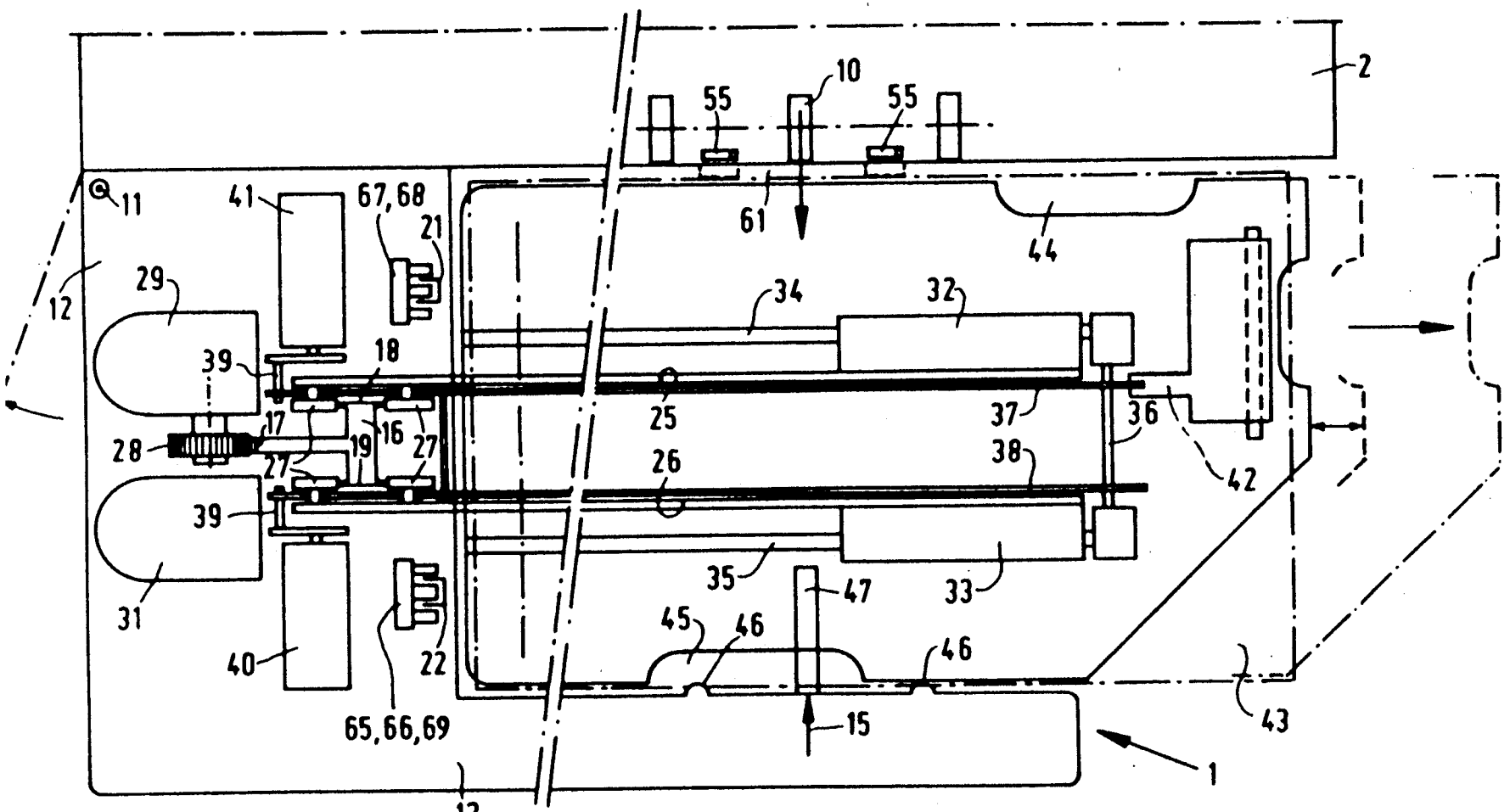
FIG. 2 is a top plan view of the device shown in FIG. 1.

Referring now to FIGS. 1 and 2, there is seen a sheet deposition or stacking device 1 situated next to a copy sheet delivery port or section 2 of a copying machine, e.g. a laser printer. The delivery part 2 projects above the copying section 3 of the copying machine and has a copy sheet delivery opening 6 at a side edge 4 which is positioned at an angle of 90° with a free top surface of the copying section 3. The sheet deposition device 1 comprises two sheet deposition trays 8 and 9 for having deposited thereon copy sheets discharged from the copying machine and is situated in the space defined by the side edge 4 of the delivery part and the top surface 5 of the copying section 3. The delivery part 2 is the type represented in U.S. Pat. No. 4,750,853 adapted to collect and staple sheets printed in the copying section 3 of the copying machine and to deliver these collected sheets (or loose sheets) through the sheet delivery opening 6 by means of a pair of conveyor rollers 10 disposed at a fixed location.

The sheet deposition device 1 is pivotally secured to the sheet delivery part 2 by means of a spindle 11 shown in FIG. 2, which extends vertically at the rear, situated opposite the operating side of the copying machine. If the sheet deposition device 1 is pivoted away from the sheet delivery part 2, the sheet delivery opening 6 and the copying section 3, situated beneath the sheet deposition device 1, are accessible, e.g. for the removal of copy sheets jammed therein. The sheet deposition device 1 pivotally secured to the sheet delivery part 2 comprises a frame with parts 12 and 13 which, considered in the horizontal direction, form an L. Frame part 12, which carries the pivot spindle 11, is situated at the rear of the copying machine remote from the operating side and accommodates fixing and drive means for the sheet deposition trays 8 and 9. Frame part 13 is situated in front of the sheet deposition trays 8 and 9, at the side remote from the delivery opening 6, and accommodates positioning means 15 for positioning on the trays 8 and 9 sheets coming out of the copying machine.

The fixing and drive means in the frame part 12 comprise a vertical column 16 to which a rack 17 and alignment guides 18 and 19 are secured. Two strips 21 and 22 are also secured in the frame part 12 and each has a U-shaped cross section with recesses in the limbs of the U. The strips 21 and 22 have a function in the displacement and positioning of the trays 8 and 9 vertically as will be explained hereinafter in detail in connection with the description of the operation of the sheet deposition device.

The mechanisms for guiding and placing trays 8 and 9 are substantially identical so that a description will only be given for the mechanism intended for this purpose for tray 8, the upper tray.

In FIG. 1, the sheet deposition device 1 is shown in a position in which the bottom sheet deposition tray 9 is in a deposition position with a stack of sheets 23 on the tray, the top sheet deposition tray 8 being shown in a parked position denoted by A, in which position sheets coming out of the sheet delivery part 2 cannot be deposited on tray 8. Sheet deposition tray 8 comprises a subframe with support arms 25 and 26 for the tray. Eight freely rotatable rollers 27 are secured to the support arms 25 and 26 and cooperate with alignment guides 18 and 19 for vertical guidance of the sheet deposition tray 8. Two of the rollers 27 are provided with collars which engage next to the associated alignment guide to enclose the tray frame in the lateral direction.

A pinion 28 is also secured to the subframe of tray 8 and engages rack 17. Pinion 28 is coupled, via a self-locking wormwheel transmission, to a motor 29 also secured to the subframe of tray 8. Motor 29 is reversible. A unidirectional bearing is built into the pinion 28 so that the tray 8 can be manually raised. When the motor 29 is energized in the required direction of rotation, tray 8 is moved up or down along the alignment guides 18 and 19, as will be explained hereinafter in connection with the description of the operation of the stacking or deposition device. On the downward movement, the loading does not increase in excess of the weight of its drive and the stack thereon. This loading is less than a maximum permissible loading of 150 N. Thus the operator cannot reach between the trays, with his hand pinched between the trays or between the bottom tray 9 and the top surface 5. To avoid the risk of pinching on the upward movement of tray 8, the same is also provided with a safety feature which prevents this tray from being driven to a position above the parking position A.

Motor 29 for driving tray 8 via pinion 28 and the corresponding motor 31 for driving tray 9 via pinion 30 are disposed next to one another, motor 29 for tray 8 extending from the tray downwards and motor 31 for tray 9 extending from the tray upwards. Thus, on the one hand, the motors 29 and 31 do not obstruct one another when the trays 8 and 9 are close together while on the other hand the motors 29 and 31 do not project above or below the deposition device 1 respectively when the trays 8 and 9 are far apart.

Guide bushes 32 and 33 respectively ar secured to the support arms 25 and 26 as shown more particularly in FIG. 2. Guide bushes 32 and 33 respectively cooperate with guide rods 34 and 35 respectively secured to the tray 8. A spindle 36 is also secured to the tray 8 and can cooperate with link 38. Link 38, and the corresponding link 37 for tray 9, extend next to the support arms 26 and 25 respectively as far as the frame part 12, where they each have a vertical slot cooperating with a pin 39 eccentrically secured on the shaft of a drive motor 40 and 41, respectively. On energization of motor 40 or the associated motor 41 for tray 9, the tray can thus be moved horizontally between two end positions in which the tray is displaced relatively to the delivery opening 6 transversely over a short distance, e.g. 25 mm. The bottom sheet deposition tray 9 is also provided with a manually operated locking means 42 by which the link 37 can be released from the spindle 36. Tray 9 can then be manually pulled farther forward as shown in FIG. 2 by the broken lines, to facilitate the removal of sheets from the tray. In order to further facilitate removal, both trays have a recess 43 to enable a stack of sheets to be easily taken hold of and removed. For the easy removal of a large stack of sheets, extra recesses 44 and 45 are formed in tray 9 for manual support of the side edges of this thick stack of sheets. The covering surface of frame part 13 situated opposite the delivery opening 6 has vertical ridges 46 which act as an abutment for the sheets delivered by the pair of rollers 10. As a result of the small contact surface between the deposited sheets and the ridges 46, the stack that is formed experiences little obstruction from transverse movements of trays 8 and 9. The risk that a stack that has been formed may shift with respect to its support can further be reduced by forming the ridges as rollers which are freely rotatable about a vertical axis and which, on transverse movement of a support with the stack thereon, participate in the movement.

The positioning means 15 disposed in frame part 13 comprises a positioning shoe 47 disposed level with the delivery opening 6. Positioning shoe 47 is movable between a working position shown in solid line in FIG. 1 and a parking position shown in broken line. In the working position shown in solid line, a horizontal surface 48 of the shoe 47 presses, solely by its own weight, on the stack 23 and an adjoining surface 49 sloping up at an angle of 45° acts as a guide for sheets delivered by transport rollers 10, to guide them to the stack 23. In the parked position shown in broken lines, the positioning shoe 47 is situated completely at the side of the ridges 46 remote from the delivery opening 6. Positioning shoe 47 is vertically movable over a small rod 50 between a position in which the shoe 47 rests on a collar 51 formed on the rod and a higher position. Guide rod 50 is rotatable about a pivot 52 and is held in the broken-line parking position by a spring (not shown), in which position deposition tray 8 particularly can move along the positioning shoe. By means of an electromagnet 53 the positioning shoe 47 can be set to the solid-line working position in which position the positioning shoe is lifted from collar 51 by the tray in the deposition position, or by the stack situated thereon.

On the side of the deposition trays removed from the positioning shoe 47, a tapper 55 is provided beneath the pair of rollers 10, which tapper is movable by means of an electromagnet 57 between a solid-line parking position in which the tapper 55, as considered in the delivery direction, is further away from the ridges 46 than the dimension of sheets to be stacked in that direction, and a broken-line position in which the tapper 55 is at a distance from the ridge 46 equal to the dimension of the sheet in the delivery direction. The position of the tapper 55 in the broken-line position can be adjusted to the dimension of the sheets in the delivery direction by adjustment of a stop 56 for the tapper 55.

During each deposition cycle, the positioning shoe 47 is first set into the solid-line working position by electromagnet 53. During the delivery of sheets by the pair of rollers 10 which takes place thereupon, the sheets are guided by guide surface 49 of the positioning shoe to the stack where they are pushed under surface 48 of the positioning shoe, in order to brake the sheets before they abut the ridges 46. After the delivery movement, tapper 55 is pressed by electromagnet 57 against the stack twice in short succession in order to press the deposited sheets straight against the abutment ridges 46. At the end of each deposition cycle, the tray on which deposition took place is moved transversely over a short distance by energization of motors 40 and 41, respectively, in order thus to enable the following sheets to be deposited in an offset position with respect to the previously deposited sheets, as indicated in FIG. 2.

The deposition device illustrated is adapted to receive a stack of about 1700 sheets of a weight of 80 $g/m^2$ on tray 9 and a stack of about 500 sheets of a weight of 80 $g/m^2$ on tray 8. Tray 8 is specially adapted to receive stapled sheets. Owing to the fact that corner-stapled sheets result in an oblique stack being formed on deposition, a stack of 500 sheets is considered the maximum feasible. For that reason, the number of sheets that can be deposited on tray 9 when the machine is set to stapling is also limited to 500 sheets, as will be explained hereinafter. The deposition device 1 is of use particularly for copying machines, such as laser printers, for large runs of short copy jobs, e.g. for direct mail, and for making a single copy of a long copying job, e.g. the printing of computer forms.

Figure 3:
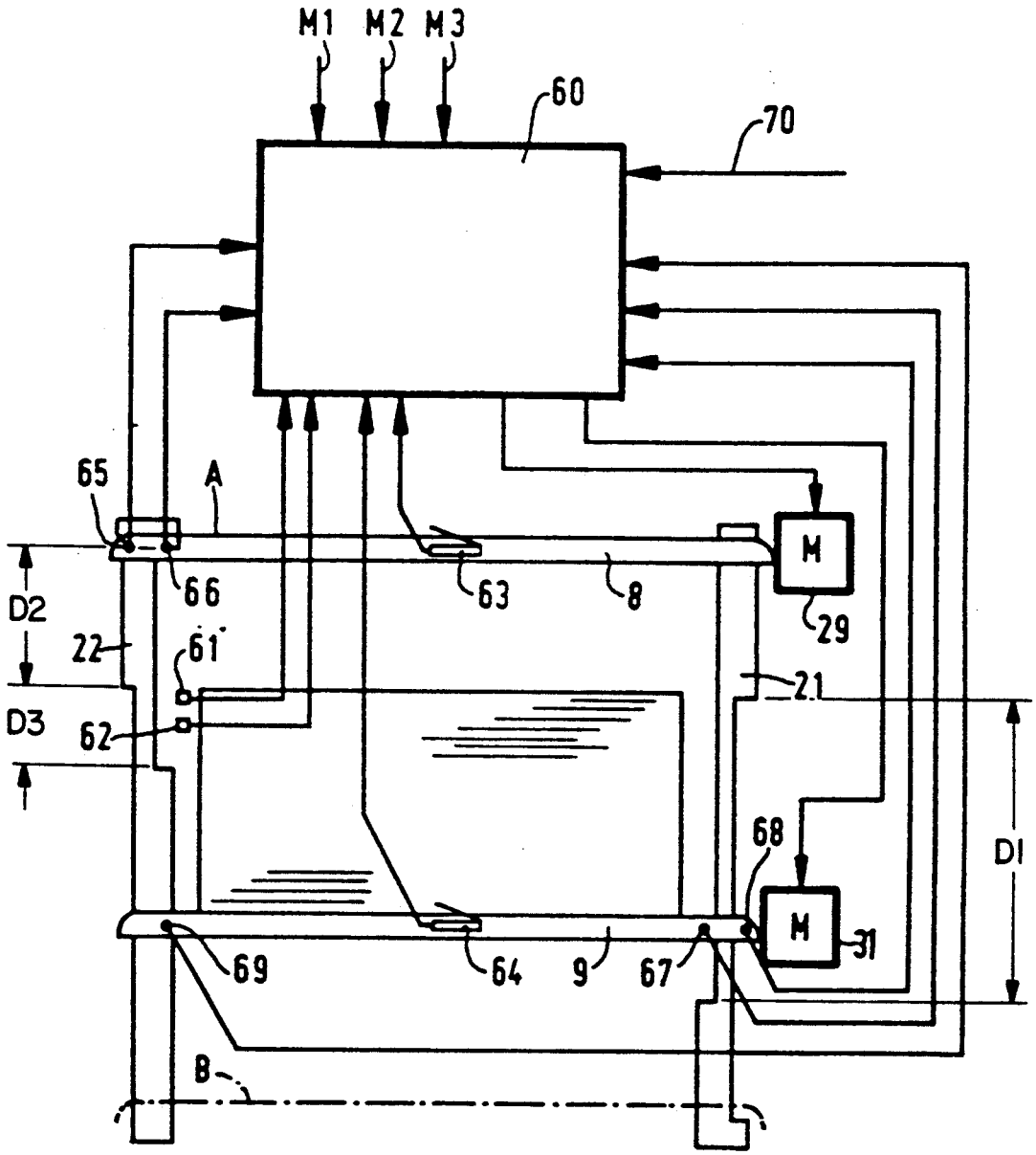
FIG. 3 is a block schematic of a control system for the device shown in FIGS. 1 and 2.

The deposition device 1 shown in FIGS. 1 and 2 is provided with a control system 60 shown in FIG. 3. The control system 60 cooperates with the following sensors disposed in the device 1. A reflection sensor 61 is disposed at the deposition height of the tray in the working position, this sensor delivering a signal when the tray in the working position or a stack of sheets thereon falls to below the sensor. A sensor 62 is disposed a short distance beneath sensor 61 and also delivers a signal when the stack formed falls to below the sensor 62. Mechanical sensors 63 and 64 are respectively disposed in trays 8 and 9 and deliver a signal when there are no sheets on the associated tray. Sensors 65 and 66 are secured to tray 8, cooperating with the limbs of strip 22 and delivering a signal on sensing the start and the end of recesses formed in the limbs of strip 22. Sensors 67 and 68 are secured to tray 9 and cooperate with the limbs of strip 21 and deliver a signal at the start and end of recesses formed in the limbs of strip 21. A sensor 69 is also secured to tray 9 and cooperates with one of the limbs of strip 22 and delivers a signal at the start and/or end of a recess formed in strip 22.

Sensors 63 and 64 operate to detect the associated trays when empty. Sensors 61 and 62 act to maintain the deposition level of the tray in the deposition position. To this end, to lower the associated tray, the motor is so controlled that the deposition level remains between the sensors 61 and 62. Together with the signaling by sensors 66 and 67 to show that the associated tray has reached the lowest position, sensor 61 also acts as an almost-full detector and sensor 62 operates also as a full detector. Sensor 65 reacts when tray 8 is at the deposition level. Sensor 68 reacts when tray 9 is at the deposition level and when tray 9 reaches parking position B. Sensor 66 reacts when tray 8 is at a distance (D3) the deposition level corresponding to 500 sheets and when tray 8 reaches its parking position A, a position defined by an upper end of a recess formed in the right limb of strip 22. The distance between the deposition level and the parking position A is represented as D2. Sensor 67 reacts when tray 9 is at a distance (D1) below the deposition level equal to 1700 sheets and corresponds to a maximum number of sheets which can be deposited on tray 9. The distance (D1) is determined by the distance between the upper end of the recess formed in the right limb of strip 21 and the end of the recess formed in the left limb of strip 21. The thickness of a stack of sheets to be formed on tray 9 relative to the next higher support is determined by the distance (D3) between the end of the recess formed in the left limb of strip 22 and the lower end of the recess formed in the right limb of strip 22.

Figure 4:
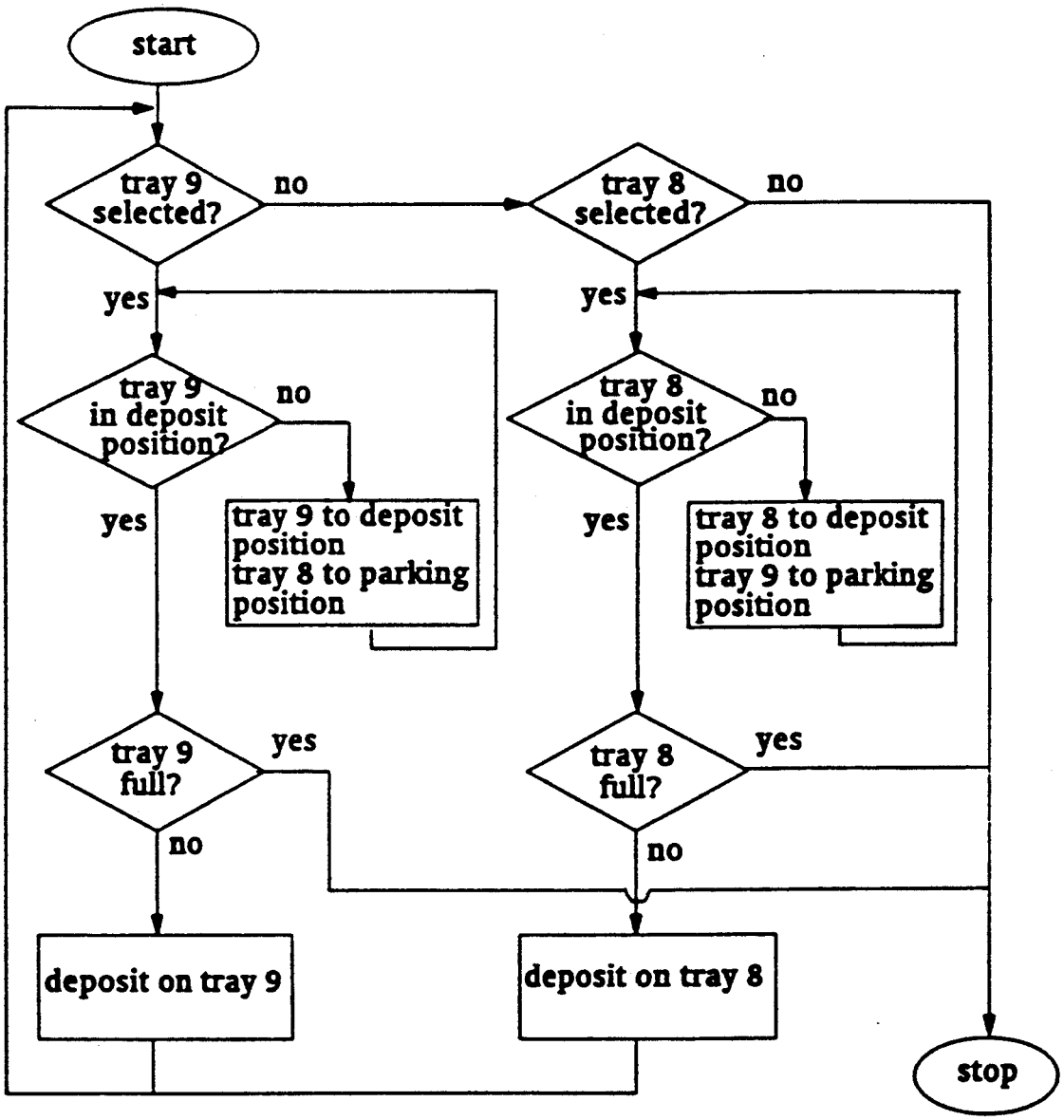
FIG. 4 is a decision diagram for the operation of the device in a first mode, the selected tray mode.
Figure 5:
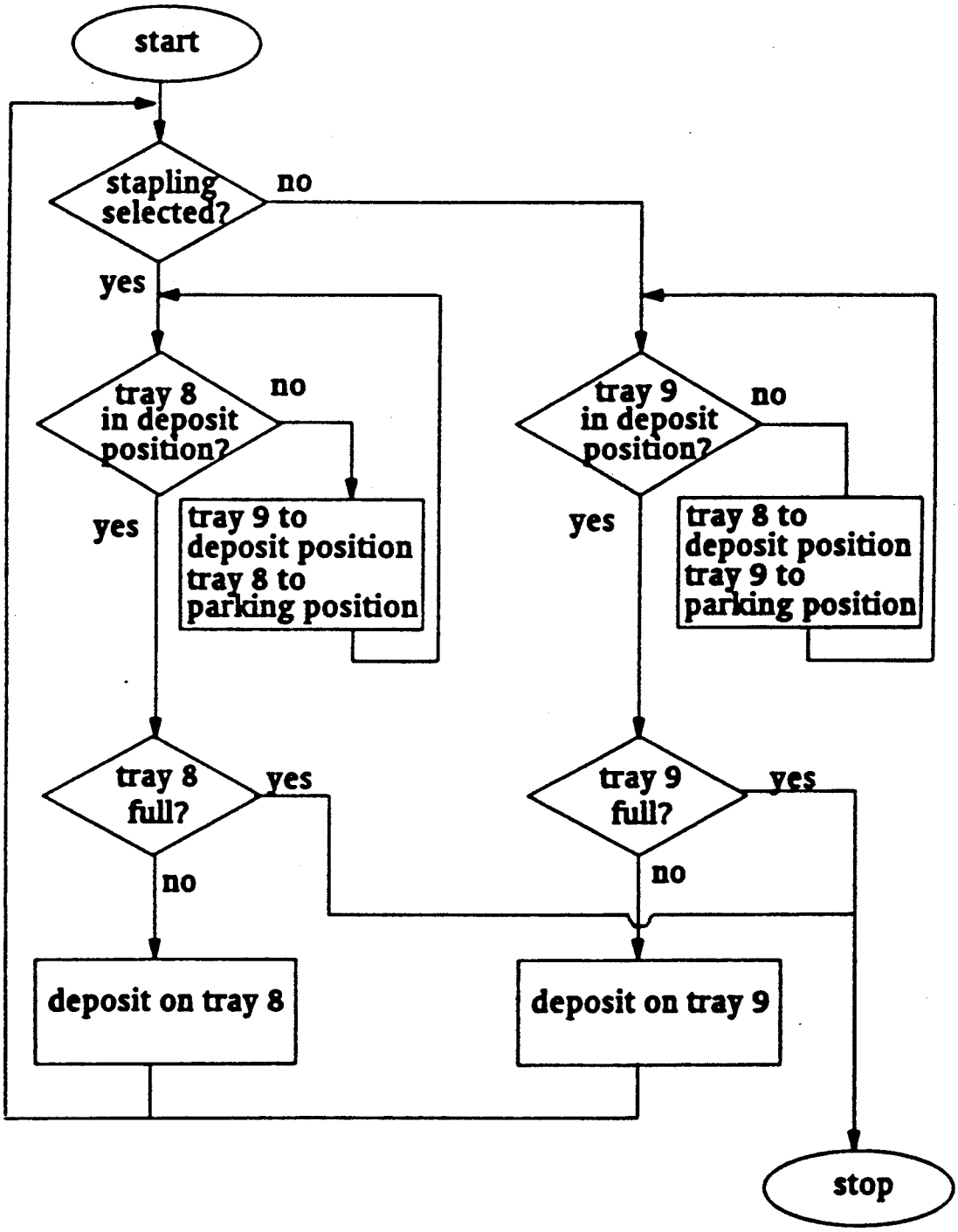
FIG. 5 is a decision diagram for the operation of the device in a second mode, the mixed mode.
Figure 6:
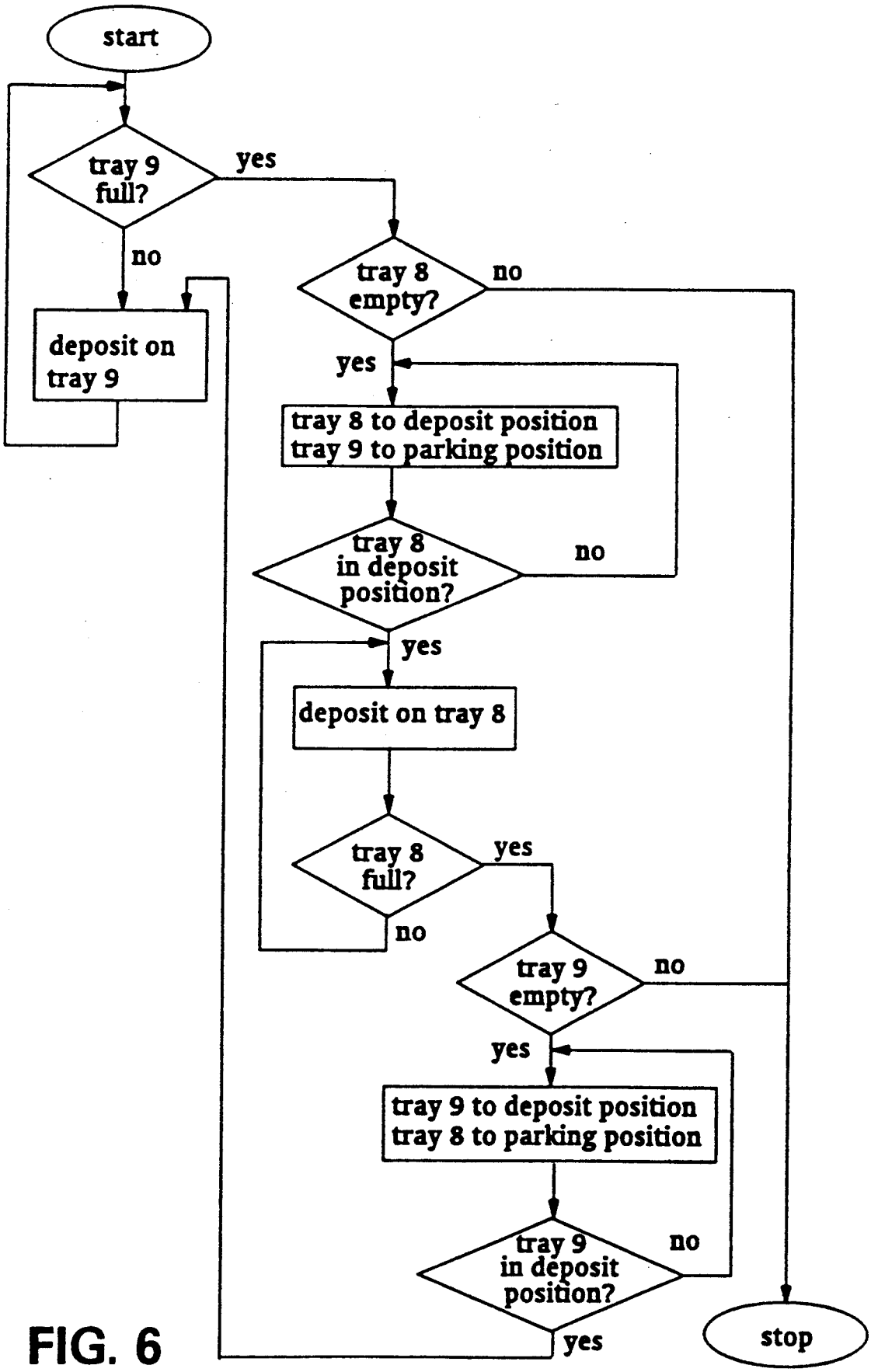
FIG. 6 is a decision diagram for the operation of the device in a third mode, the continuous mode.

The operation of the device will now be explained by reference to the block schematic shown in FIG. 3, of a control device 60 operating in dependence on the mode (M1, M2 or M3) to which the control system 60 is set and by reference to decision diagrams of those modes, as shown in FIGS. 4, 5, and 6. A signal 70 representing the setting of the sheet delivery part 2 to stapling can also be added to the control system.

In mode M1, the selected tray mode, of which FIG. 4 shows the decision diagram, either tray 8 or 9 can be selected for use. Deposition can take place only on the selected tray. If the associated tray is full, the copying process stops as does also the deposition of the following copy sheets. After the sheets have been removed from the associated tray, the copying process can be restarted and deposition resumed. The tray-full signal is dependent upon the selected tray and the presence of a signal 70. In the absence of signal 70, full-detection for tray 9 takes place at 1700 sheets and for tray 8 at 500 sheets. In the presence of signal 70, full-detection takes place for both trays at 500 sheets.

In mode M2, the mixed mode, the decision diagram of which is shown in FIG. 5, stapled sheets, i.e. in the presence of signal 70, are automatically deposited on tray 8 and unstapled sheets, i.e. in the absence of signal 70, are automatically deposited on tray 9. On the changeover from stapling to non-stapling, or vice versa, the other tray is automatically placed in the deposition position. The copying process and hence delivery and deposition of sheets stops when it is no longer possible to deposit the following sheets, or because the following sheets have to be stapled and the tray 8 is full, or because the following sheets are to be left unstapled and the tray 9 is full.

In mode M3, the continuous mode, the decision diagram of which is shown in FIG. 6, deposition of sheets starts with an empty tray 9 in the deposition position. When the maximum number of sheets has been deposited on tray 9 (about 1700 sheets with the non-stapling setting and 500 sheets with the stapling setting), tray 9 is automatically moved further down into the parked position B and tray 8, provided it is empty, is automatically lowered from its parked position A to the deposition position and deposition is continued on tray 8. With normal copying speeds, it takes about 10 minutes before tray 8 is full. If in that period all the sheets have been removed from tray 9, then when tray 8 is full, deposition will be continued on tray 9. If not all the sheets have been removed then sheet deposition stops. This prevents any disturbance to the sequence in which the sheets are deposited. Thus, the copying process can be continued uninterrupted without it being necessary to break it off to remove sheets from the deposition device 1.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet deposition system for depositing sheets on at least two supports situated one above the other, comprising:

providing a sheet deposition device including a means for selectively placing the supports in a sheet deposition position; and sheet deposition means for depositing a sheet on a support disposed in said sheet deposition position or on a stack of sheets disposed on said support, wherein a first support of said at least two supports is movable into a position in which a distance to a next higher support is less than a predetermined maximum thickness of a stack of sheets to be formed on said first support.

2. A system according to claim 1, wherein said predetermined maximum thickness of the stack of sheets to be formed on the first support is greater than a maximum thickness of a stack of sheets to be formed on the next higher support.

3. A system according to claim 1, wherein the number of supports is two.

4. A system according to any one of claims 1-3, wherein said first support is movable between a sheet deposition position in which a distance between said first support and said sheet deposition means disposed at a fixed position corresponds to the thickness of the stack of sheets formed on said first support and a parking position (B) at which the first support is situated at a distance beneath said sheet deposition means corresponding to the sum of the maximum thicknesses of the stacks formable on the first support and the next higher support, and said next higher support is movable between a deposition position in which the distance between said support and said sheet deposition means corresponds to the thickness of said stack of sheets to be formed on said next higher support and a parking position (A) in which said next higher support is situated at a distance above said sheet deposition means corresponding to the thickness of said next higher support.

5. A system according to claim 4, further including a control means which comprises a first detection means for generating a first detection signal in the presence of a stack of sheets of maximum thickness when a support is in the deposition position, and wherein said control means places an associated support from its deposition position into its parking position in response to said first detection signal.

6. A system according to claim 5, wherein said control means comprises a second detection means for each support for generating a second detection signal in the absence of sheets on an associated support and wherein said control means places said associated support from its parking position into a deposition position in response to said second detection signal.

7. A system according to claim 6, wherein said control means is adjustable by a first adjustment signal to a mode in which only said first support can be moved into a deposition position and by a second adjustment signal to a mode in which only the next higher support is movable into a deposition position.

8. A system according to claim 7, wherein said first adjustment signal corresponds to a first property of sheets to be deposited and said second adjustment signal corresponds to a second property, differing from the first of the sheets to be deposited.

9. A system according to claim 4, further including a sheet guide means disposed at a height of said sheet deposition means and at a side of said supports remote from said sheet deposition means, said sheet guide means being movable between an operative position in which said sheet guide means extends above a support in the deposition position to guide a sheet to be deposited to its deposition position on said respective support and an inoperative position in which said sheet guide means is situated completely outside a path of movement of said supports.

10. A system according to claim 7, further including a sheet pressure application means disposed on a side of the supports where said sheet deposition means is situated, and is movable between a position in which said sheet pressure application means presses a deposited sheet in the direction of a sheet guide means against an abutment which extends along said supports and a withdrawn position in which said sheet pressure application means is free from deposited sheets.

11. A system according to claim 1, wherein each of said at least two supports is provided with a gearwheel drivable by a motor, said gearwheels cooperating with a rack which extends next to said supports and in a vertical direction of movement thereof.

* * * * *